US007526845B2

(12) United States Patent
Müller et al.

(10) Patent No.: US 7,526,845 B2
(45) Date of Patent: May 5, 2009

(54) NOZZLE BEAM IN A DEVICE FOR GENERATING LIQUID JETS

(75) Inventors: Thomas Müller, Friedberg (DE); Christoph Wolf, Langen (DE)

(73) Assignee: Fleissner GmbH, Egelsbach (DE)

( * ) Notice: Subject to any disclaimer, the term of this patent is extended or adjusted under 35 U.S.C. 154(b) by 344 days.

(21) Appl. No.: 11/562,638

(22) Filed: Nov. 22, 2006

(65) Prior Publication Data

US 2007/0295839 A1 Dec. 27, 2007

(30) Foreign Application Priority Data

Nov. 24, 2005 (DE) ..... 10 2005 055 939

(51) Int. Cl.
*D04H 1/46* (2006.01)
*D06B 5/02* (2006.01)

(52) U.S. Cl. ..... 28/104; 28/167; 239/553.5

(58) Field of Classification Search ..... 2/104, 2/105, 167; 239/553.5, 553.3, 590.3, 590.5, 239/600; 68/205 R See application file for complete search history.

(56) References Cited

U.S. PATENT DOCUMENTS 3,613,999 A * 10/1971 Bentley et al. ..... 239/553.3
5,042,722 A * 8/1991 Randall et al. ..... 239/553.5
5,692,278 A * 12/1997 Fleissner ..... 28/105
5,778,501 A * 7/1998 You ..... 28/104
5,933,931 A * 8/1999 Greenway ..... 28/167
6,105,222 A * 8/2000 Fleissner ..... 28/104
6,343,410 B2 * 2/2002 Greenway et al. ..... 28/104
7,441,315 B2 * 10/2008 Munstermann ..... 28/104

FOREIGN PATENT DOCUMENTS

EP 1472397 11/2004

* cited by examiner

*Primary Examiner*—Amy B Vanatta
(74) *Attorney, Agent, or Firm*—Andrew Wilford

(57) ABSTRACT

Nozzle beam on device for generating liquid jets for jet interweaving of the fibers of a fiber path, comprising an upper part that extends over the operational width of the fiber path, and a lower part that is attached to it in liquid-sealed fashion, wherein a) a pressure chamber is arrayed in the upper part over its length, to which liquid under pressure is fed, and b) a pressure-distributing chamber is provided parallel to chamber (a), which is connected with chamber (a) via liquid flow-through boreholes situated in an intermediate partition, and c) on the lower part, a nozzle strip having boreholes for the nozzle chamber is supported in liquid-sealed fashion, and d) (b) on the area that lies opposite the liquid flow-through boreholds runs out into a slot that terminates at the boreholes of the nozzle strip, and e) in (b) between the liquid flow-through boreholes and the slot, a baffle is situated over the length of the slot, which over its length and over its cross section is situated in (a) so as to allow free flow around it, and the baffle is not screwed to the nozzle beam, but rather inserted into it and can be removed from it, the baffle being held by spacers in a centric or eccentric position.

5 Claims, 2 Drawing Sheets

NOZZLE BEAM IN A DEVICE FOR GENERATING LIQUID JETS

CROSS-REFERENCE TO PRIOR APPLICATION

Figure 1:
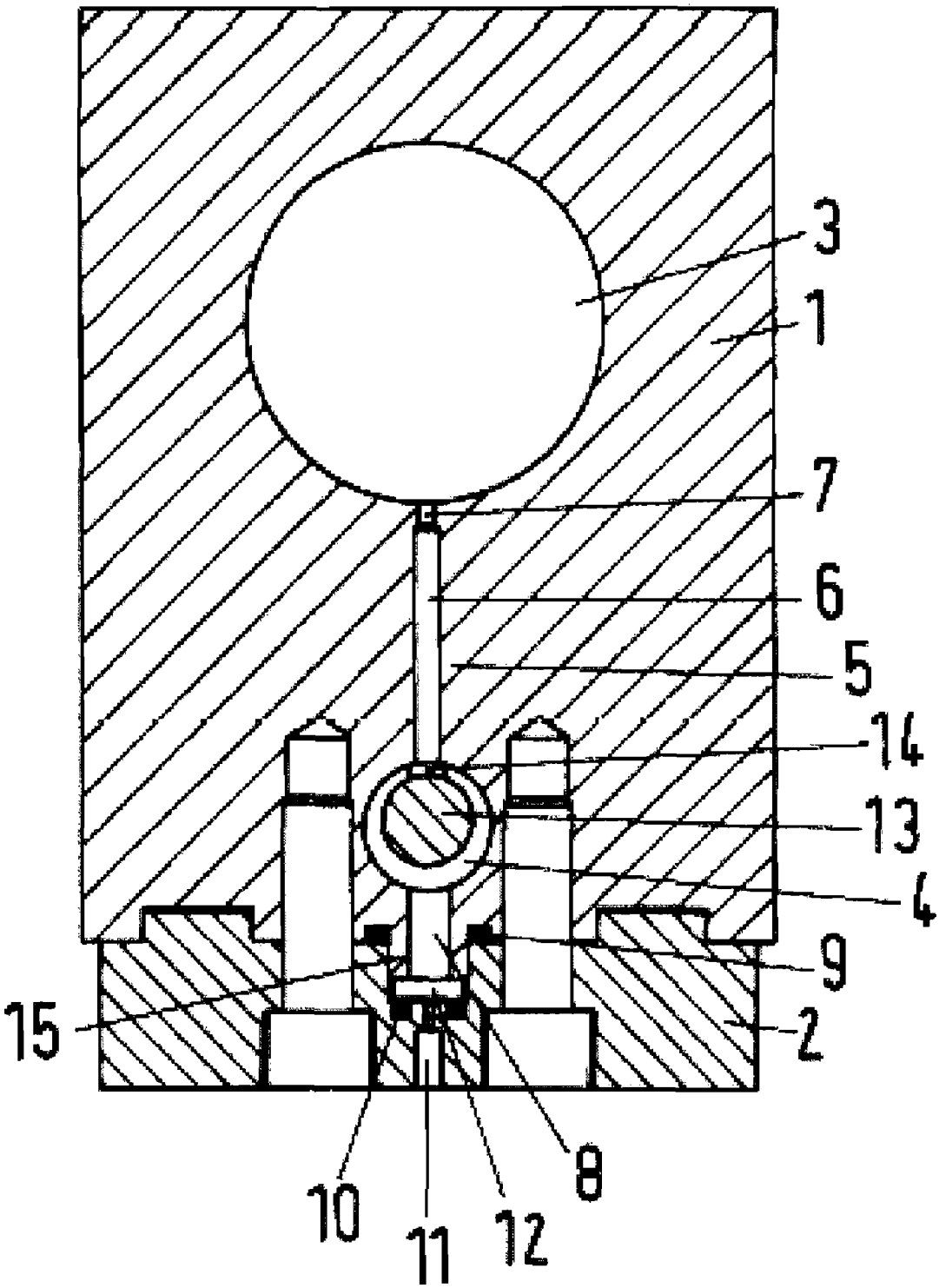

This application claims priority from German Application 10 2005 055 939.5, filed on Nov. 24, 2005 and incorporated by reference in its entirety.

FIELD OF THE INVENTION

The subject of the invention is a nozzle beam in a device for generation of liquid jets, causing an interweaving of the fibers of a fiber path run along the nozzle beam.

BACKGROUND OF THE INVENTION

A nozzle beam is already known from European patent text EP 1 472 397 B1, on a device for generating liquid jets for jet interweaving of fibers along a fiber path along the beam, which consists of (or which comprises) an upper part that extends over the operational width of the fiber path and a lower part that is attached to it. In the upper part, along its length, a pressure chamber is placed, to which the pressurized liquid is brought, for example on its front side. Parallel to it, a pressure-distributing chamber separated by an intermediate partition is provided, which is connected with the pressure chamber via a liquid flow-through borehole in the partition. On the lower part, a nozzle plate is supported in liquid-sealed fashion with the boreholes for the nozzles. In the pressure-distributing chamber, a round baffle is placed, eccentric to the axis of the round pressure-distributing chamber in the direction toward the flow-through boreholes, to smooth the liquid flow toward the boreholes in the nozzle strip.

It has been observed that again and again bacterial cultures take hold in the pressure-distributing chamber, if the unit is operated with certain fibers such as cotton fibers, with the bacteria especially settling on the baffle rod. If other fibers such as clean chemical fibers are processed, such problems are scarcely observed at all. These bacteria cultures lead to an undesired contamination of the water circulation loop, which would above all not be appropriate for production of hygiene articles, for which high hygienic standards are set by the customer.

Therefore it is required that the pressure-distributing chamber and the baffle be cleaned regularly and that it be made free of microorganisms that have settled there.

However, such a cleaning becomes difficult in that a cleaning rod must be inserted into the pressure-distributing chamber for the cleaning, and this can only happen if the baffle has first been removed.

From a technical standpoint, to remove the baffle from the pressure-distributing chamber is extraordinarily costly. This is because the baffle is securely screwed in a borehole in the pressure-distributing chamber, and can only be removed if previously the entire lower part of the nozzle beam is dismantled. This, however, results in hydraulically needle-punched product paths experiencing hours of down time.

Therefore the task is to develop a new nozzle beam in which it is easier to clean the pressure-distributing chamber and the baffle. Especially it depends on being able to remove the baffle from the pressure-distributing chamber without being forced to dismantle the entire lower part of the nozzle beam. This goal can be attained by no longer screwing the baffle in the pressure-distributing chamber, but rather only inserting it, so that it can easily be extracted laterally from the pressure-distributing chamber. The baffle's required eccentric position in the pressure-distribution chamber can be attained by having its position be adjusted by spacers in the pressure-distribution chamber, which are slid up onto the baffle as interrupted metallic rings with a spacer ring that is open toward the bottom, and placed at specified intervals.

SUMMARY OF INVENTION

Therefore the subject of the invention is a nozzle beam on a device for generating liquid jets for jet interweaving of the fibers of a fiber path, which consists of (or which comprises) an upper part that extends over the operational length of the fiber path, and a lower part that attaches to it in liquid-sealed fashion, wherein a) a pressure chamber is arrayed in the upper part over its length, to which pressurized liquid is fed, and
b) parallel to that, with an intermediate partition, a pressure-distributing chamber is provided, which is connected with the pressure chamber via liquid flow-through boreholes situated in the partition, and
c) a nozzle plate with the boreholes for the nozzle chamber is supported on the lower part in liquid-sealed fashion, and
d) the pressure-distributing chamber on the area that lies opposite the liquid flow-through boreholes runs out into a slot that terminates at the boreholes of the nozzle plate, and
e) in the pressure-distributing chamber between the liquid flow-through boreholes and the slot, a baffle is situated over the length of the slot, which over its length and over its cross section is situated in the pressure-distributing chamber so as to allow free flow around it, and wherein the baffle is not screwed to the nozzle beam, but rather inserted into it and can be extracted from it, the baffle being held by spacers in a centric or eccentric position.

In the device according to the invention, the nozzle beam is provided with a baffle, which preferably is placed eccentrically in the pressure-distributing chamber in the direction of the flow-through boreholes. It has been shown that the flow passing around the baffle becomes more homogeneous, and less turbulence arises in the pressure-distributing chamber. The liquid flow from the outward flow area of the liquid at the liquid flow-through boreholes and about the baffle, which, owing to the eccentric position toward the wall of the pressure-distributing chamber, leaves open more free space for the subsequent smoothing of the vortices, makes it possible for the water jets that form in the nozzle strips to have a cleaner appearance.

It is advantageous if, additionally, care is taken to make the flow homogeneous even before the pressure-distributing chamber. This is possible by homogenizing the liquid flow not just in the pressure-distribution space, but also in the expanding drain-off area, in which the flow-through boreholes in the partition are first configured to have a narrow opening for the inflow (7) and then a borehole (6) for the liquid flow.

BRIEF DESCRIPTION OF THE DRAWINGS FIGURES

A device according to the invention is depicted as an example in the drawings. Shown are:

FIG. 1: a section through the nozzle beam, and

Figure 2:
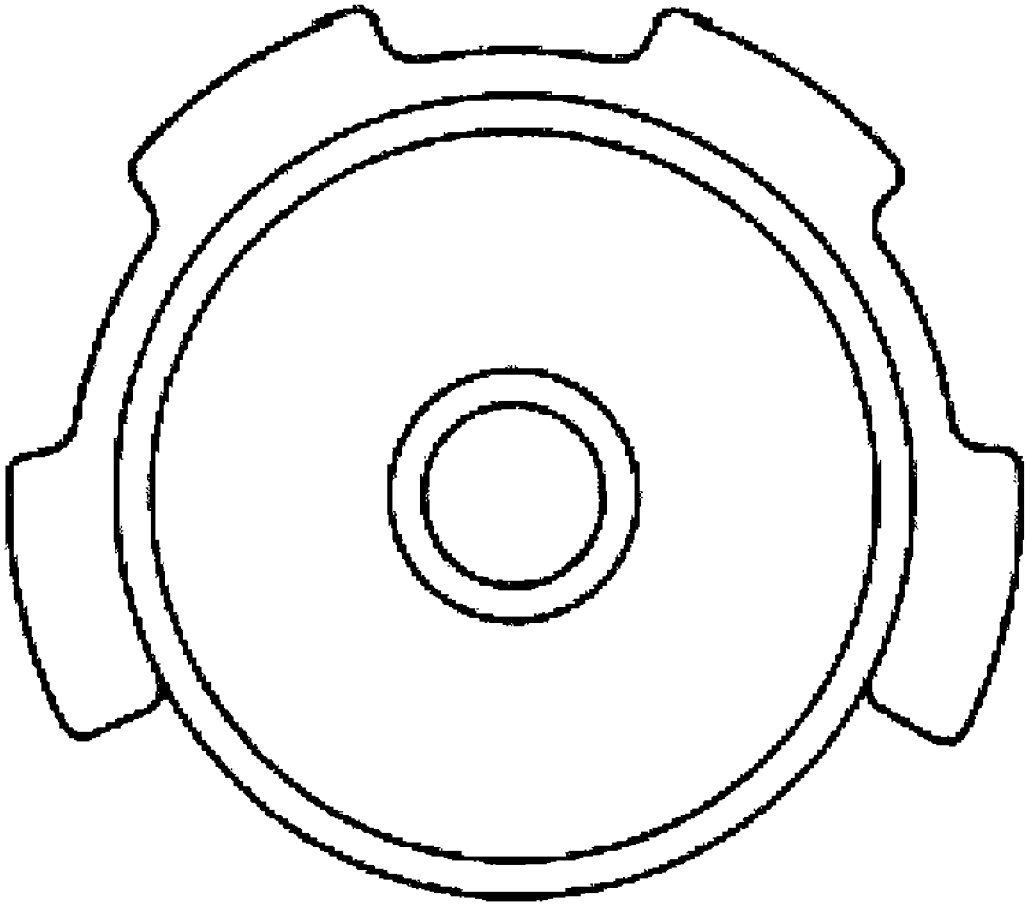

FIG. 2: spacers that are placed on the baffle.

DETAILED DESCRIPTION

FIG. 1 shows a nozzle beam according to the invention. The housing of the nozzle beam consists of an upper part 1 that is screwed from below into lower part 2 in numerous places along the length. Upper part 1 has two boreholes 3 and 4, of which the upper is the pressure chamber 3 and the lower is the pressure-distributing chamber 4. Both chambers are open on the one front side, and are screwed in on the other side so as to be liquid-sealed. Via the opening present there, the pressurized liquid can be admitted into pressure chamber 3. The two chambers 3 and 4 are separated from each other by an intermediate partition 5. Over the length of the nozzle beam, a large number of flow-through boreholes 6 in the partition 5 connect the two chambers, so that the liquid entering pressure chamber 3 is evenly distributed over the length as it flows out into pressure-distributing chamber 4. The pressure-distributing chamber is open downwards via a narrow slot, which likewise extends along the length of the beam.

Upper part 1 is screwed securely to lower part 2 and is liquid-sealed. The seal is effected by O-ring 9, which fits into an annular groove of upper part 1. In the middle between O-ring 9, the slot 8 surrounds a spring projection 15, which is fitted into a matching groove of the lower part, and with its outer edge holds the nozzle plate through contact with the nozzle strip 12. In the base of the groove of lower part 2 in turn an annular groove is created into which O-ring 10 fits to seal the nozzle strip. In a line beneath the liquid flow-through boreholes 6 and the slot 8, a slot 11 is likewise made, whose upper part is vary narrow and leaves open only slightly more than the width of the effective nozzle opening of nozzle strip 12.

According to the invention, the pressure-distributing chamber 4 is created via a borehole into the nozzle beam housing. For the liquid to exit from pressure-distributing chamber 4 toward nozzle strip 12, slot 8 is fitted, which is thus smaller than the cross section of pressure distribution chamber 4. The liquid entering through the flow-through boreholes 6 should be evenly distributed in the distribution chamber. Of service for this is the volume of pressure-distributing chamber 4 and a baffle 13, which is maintained throughout the length of pressure distribution chamber 4 between the boreholes 6 and slot 8. The baffle is kept at an interval to partition 5 and the liquid can flow around it on all sides. To make this possible, on the baffle, spacers are attached in multiple locations over the length of the nozzle beam, which [spacers] advantageously are welded to the baffle and are open facing down. In this way, the liquid, from the flow-through boreholes, first encounters the baffle 13, gets distributed in distribution chamber 4 and then flows at the same pressure over the length of the beam through the small boreholes of nozzle strip 12.

As FIG. 1 shows, the circular baffle 13 is not placed centrically, but rather is displaced in the direction of the flow-through boreholes 6. The effect of this eccentric placement is that in the still free pressure-distributing space 4, a more even, loss-free, flow-enhancing liquid flow is produced toward nozzle strip 12. The result of this is cleanly formed water jets, which can also then transmit greater energy to the product path.

In the invention-specific device, baffle 13 is not screw-connected with the nozzle beam, but rather merely held in its position in pressure-distributing chamber 4 by spacers. Therefore, over its entire length it can be extracted from the pressure-distributing chamber. This arrangement has another great advantage in that the baffle does not have to be attached by an otherwise customary lowering borehole, with the repeated result that the water jet becomes turbulent and thus the laminar flow becomes disturbed. Over the entire length of the baffle, the surface now is uniform and homogeneous without drops in the flow. It is true that the spacers themselves do not secure the baffle rod against torsion, but rather the securing occurs, for example, by a groove-and-spring design at the front side of the baffle rod.

According to the invention, a disinfecting rod can be inserted into the pressure-distributing chamber, that removes the colonies of microorganisms with a disinfecting solution or with hot water. After pressure-distributing chamber 4 and baffle rod 13 have been cleaned, it [rod] is reinserted into the pressure-distributing chamber and this is closed by a lid.

The invention-specific nozzle beam with an easily removable baffle makes it easy to clean and remove microorganisms that have settled in the pressure-distributing body, without necessitating complete dismantling of the pressure beam's lower part.

FIG. 2 shows the spacer placed on the baffle. The spacer secures the baffle against torsion, and thus can ensure that the liquid flow is uniform.

What is claimed is:

1. Nozzle beam on a device for generation of liquid jets for jet interweaving of the fibers of a fiber path, the beam consisting of an upper part extending over the operational width of the fiber path, and a lower part that is attached to it in liquid-sealed fashion, wherein a) a pressure chamber is arrayed in the upper part over its length, to which liquid under pressure is fed, and b) parallel to the pressure chamber, with an intermediate partition, a pressure-distributing chamber is provided, which is connected with the pressure chamber via liquid flow-through boreholes situated in the partition, and c) a nozzle strip is provided on the lower part, having boreholes for a nozzle chamber and being supported in liquid-sealed fashion, and d) the pressure-distributing chamber runs out into a slot in the area that lies opposite the liquid flow-through boreholes, the slot terminating at the boreholes of the nozzle strip, and e) in the pressure-distributing chamber between the liquid flow-through boreholes and the slot, a baffle is situated over the length of the slot, which over its length and over its cross section is situated in the pressure-distributing chamber so as to allow free flow around it, characterized in that the baffle is not screwed to the nozzle beam, but rather inserted into it and can be removed from it, the baffle being held by spacers in a centric or eccentric position.

2. Nozzle beam according to claim 1, characterized in that the spacers are welded to the baffle.

3. Nozzle beam according to claim 1, characterized in that the spacers attached to the baffle are open facing downward.

4. Nozzle beam according to claim 2, characterized in that the spacers attached to the baffle are open facing downward.

5. Nozzle beam on a device for generation of liquid jets for jet interweaving of the fibers of a fiber path, the beam comprising of an upper part extending over the operational width of the fiber path, and a lower part that is attached to it in liquid-sealed fashion, wherein a) a pressure chamber is arrayed in the upper part over its length, to which liquid under pressure is fed, and b) parallel to the pressure chamber, with an intermediate partition, a pressure-distributing chamber is provided, which is connected with the pressure chamber via liquid flow-through boreholes situated in the partition, and c) a nozzle strip is provided on the lower part, having boreholes for a nozzle chamber and being is supported in liquid-sealed fashion, and d) the pressure-distributing chamber runs out into a slot in the area that lies opposite the liquid flow-through boreholes, the slot terminating at the boreholes of the nozzle strip, and e) in the pressure-distributing chamber between the liquid flow-through boreholes and the slot, a baffle is situated over the length of the slot, which over its length and over its cross section is situated in the pressure-distributing chamber so as to allow free flow around it, characterized in that the baffle is not screwed to the nozzle beam, but rather inserted into it and can be removed from it, the baffle being held by spacers in a centric or eccentric position.

* * * * *